US006869154B2

(12) United States Patent
Vandenbussche

(10) Patent No.: US 6,869,154 B2
(45) Date of Patent: Mar. 22, 2005

(54) CONVERTIBLE ILLUMINATED DISPLAY CASE

(75) Inventor: Francis Vandenbussche, Vaucresson (FR)

(73) Assignee: Chanel (FR)

( * ) Notice: Subject to any disclaimer, the term of this patent is extended or adjusted under 35 U.S.C. 154(b) by 60 days.

(21) Appl. No.: 10/199,527

(22) Filed: Jul. 19, 2002

(65) Prior Publication Data

US 2003/0015945 A1 Jan. 23, 2003

(30) Foreign Application Priority Data

Jul. 19, 2001 (FR) ..... 01 09674

(51) Int. Cl.[7] ..... A47F 3/00
(52) U.S. Cl. ..... 312/114
(58) Field of Search ..... 312/114, 117, 312/118, 138.1, 257.1, 265.6, 223.5; 40/442, 541; 362/362

(56) References Cited

U.S. PATENT DOCUMENTS 1,728,610 A * 9/1929 Horton ..... 40/414
2,163,562 A 6/1939 Putnam et al. ..... 40/553
3,736,832 A * 6/1973 Franke et al. ..... 84/464 R
4,201,002 A * 5/1980 Barton ..... 40/524
4,810,044 A * 3/1989 Dahnert ..... 312/223.5
5,311,686 A * 5/1994 Christensen et al. ..... 40/442
5,865,516 A * 2/1999 Woy ..... 312/125

FOREIGN PATENT DOCUMENTS

DE 41 19 975 A1 12/1992
FR 984563 * 7/1951

* cited by examiner

*Primary Examiner*—James O. Hansen
(74) *Attorney, Agent, or Firm*—VanOphem & VanOphem P.C.

(57) ABSTRACT

A convertible illuminated display case for drawing attention to an object or image. The display case includes a box having a front opening with a rim extending along at least a portion of its perimeter. The box has a removable front panel with a translucent wall. The display case also includes a support adapted to provide a base for displaying an object, and the support is further adapted for placement within the box. Rear cold light sources are disposed at the back of the box, and front cold light sources are disposed inside the box near the rim. A power supply device is connected to the front and rear cold light sources.

17 Claims, 3 Drawing Sheets

CONVERTIBLE ILLUMINATED DISPLAY CASE

CROSS-REFERENCES TO RELATED APPLICATIONS

French patent application 0109674 filed 19 Jul. 2001.

BACKGROUND OF THE INVENTION

1. Field of the Invention

The invention relates to a convertible illuminated display case for drawing attention to one or more objects or to an image, possibly an image reproducing objects.

2. Description of the Related Art

Display cases having a base adapted to receive one or more objects, and light sources facing the base to draw attention to the object or objects are already known in the art. In some cases, the base is placed in a niche that is brightly lit compared to its surroundings, so that it attracts the eye and therefore draws attention more strongly to whatever is placed on the base.

Illuminated panels including a translucent wall representing one or more objects (or any other image, for example a portrait or a landscape) are also known in the art. The panel is situated in front of one or more light sources.

Combining such devices could be considered, in order to dress a wall, for example a store wall. Niches lit individually can be placed in a required geometry with illuminated panels between them carrying images lit from behind. However, once an arrangement of such devices has been assembled, any modification of the arrangement involves completely demounting the niches and the panels, including their specific electrical connections.

Note that conventional illuminated display cases generally require bulky and power-hungry light sources in order to generate sufficient illumination. Such conventional illuminated display cases therefore generate a great deal of heat, which in the long term can damage the image or the product to which attention is to be drawn.

BRIEF SUMMARY OF THE INVENTION

The present invention provides a convertible illuminated display case usable at will, and without complex demounting, either as an illuminated panel for drawing attention to an image or as a niche for displaying one or more objects, the display case providing sufficient illumination to draw attention to the image or the product without generating heat liable to damage the image or the product.

To this end, the present invention proposes a convertible illuminated display case including:

- a box having a front opening with a rim extending along at least a portion of its perimeter;
- a removable front panel including a translucent wall;
- a support adapted to provide a base for displaying at least one object and intended to be placed in the box;
- rear cold light sources disposed at the back of the box;
- front cold light sources disposed inside the box near the rim; and
- a power supply circuit connected to the rear light sources and to the front light sources.

A display case of the above kind is convertible in the sense that it has a choice of two configurations, according to whether the removable front panel is fitted or not (when this panel is fitted, and closes off the opening, the support can remain in place, but it is generally preferable to remove it for direct illumination of the transparent wall by the rear sources).

The front and rear light sources are cold light sources that do not generate any significant heat. It is therefore possible to fit as many sources as required (within the limits of the available overall size, of course) without fear of damaging the translucent wall or the product displayed.

It is naturally possible to provide a wall, for example a store wall, with an array of display cases of the above kind (and to make the appropriate electrical connections), independently of their future use, and then to configure each of them as required to obtain an intended overall effect. If it is subsequently necessary to modify the overall effect, it is sufficient to change the configuration of some of the display cases, some of which, originally configured as illuminated panels, are reconfigured as niches, while others, originally configured as niches, are reconfigured as illuminated panels, and the remainder, whether originally configured as niches or as illuminated panels, are not changed. It is important to note that, by virtue of the convertible nature of the display cases, any change of general effect requires minimal manipulations (fitting (or removing) front panels and fitting (or removing) bases), in particular without demounting the boxes or their electrical connections.

Although the display case according to the invention aims to draw attention to an image or a product, it must be understood that some of the aforementioned display cases can, if required, have a wall that is the same color all over or white all over, which corresponds to images of a particular type.

The cold light sources are preferably light-emitting diodes, some of which have powers compatible with lighting functions. They are very easy to install because of their small dimensions and their low power consumption.

The display case advantageously provides a choice of lighting conditions, i.e. the power supply circuit has two or more operating modes corresponding to different modes of energization of the front light sources and the rear light sources. Clearly, when the panel is fitted, it may be necessary for the rear lighting to be dominant whereas, to draw attention to a product, the front lighting may need to dominate although the rear lighting can remain on, for example to create a halo effect. For example, in accordance with the present invention, in a first operating mode at least some of the rear light sources are energized less strongly than in a second operating mode, while in the first mode at least some of the front sources are more strongly energized than in the second mode.

The front sources advantageously take the form of diverse groups each having a choice of energization modes. By modifying the energization modes of the various groups separately, a wide variety of lighting effects can be obtained, for drawing attention to diverse aspects of the product displayed.

The rear sources are preferably in a central area of the back of the display case, and are advantageously distributed in an array that is at least approximately periodic. This leads to homogeneous illumination which is particularly suitable for lighting the translucent wall of the front panel, or even the support, from behind.

The box preferably has a polygonal section (for example a rectangular or even square section), that facilitates assembling a set of contiguous display cases; in this case, the array of rear sources advantageously includes rows of sources parallel to at least some of the walls of the box, which leads to an aesthetic geometry of the backlighting effect.

The front sources can be divided into groups having a particular spatial arrangement with respect to the box. Thus the front sources advantageously include two or more groups of sources disposed laterally on either side of the opening. This provides a choice of symmetrical or asymmetrical right-hand and left-hand lighting effects. By analogy, the front sources advantageously include two or more groups of sources disposed at the top and at the bottom of the box (whether in addition to the right-hand and left-hand groups previously cited or not).

The light sources are preferably the same color, which can meet most illumination requirements: the color white is particularly suitable.

The support advantageously includes a back wall which has a sufficiently large area to conceal the rear light sources; this produces an agreeable halo effect, and provides diffuse illumination if the back wall is made from a translucent material. Other aesthetic choices can of course be made.

The support can also take a slightly more complex form, so as to fill better the internal volume of the box. Accordingly, in one embodiment of the invention, the support includes a back wall and a front wall incorporating an opening facing the back wall, the back wall and the front wall having dimensions and being disposed relative to one another so that they conjointly conceal the rear light sources.

Other objects, features and advantages of the present invention will emerge from the following description, which is given by way of non-limiting illustrative example and with reference to the accompanying drawings, in which:

DETAILED DESCRIPTION OF THE PREFERRED EMBODIMENT

Figure 1:
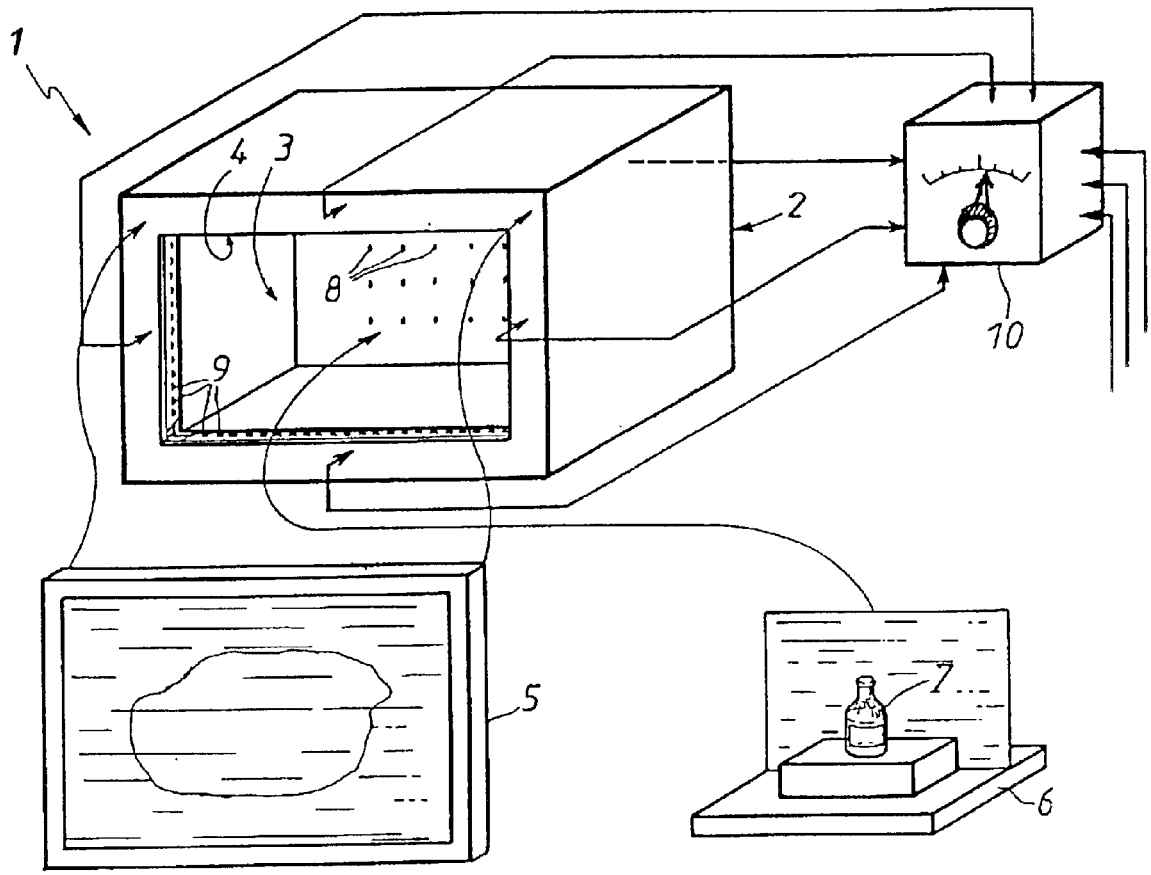
FIG. 1 is a diagrammatic perspective view of a convertible illuminated display case according to the present invention.

FIG. 1 shows diagrammatically the general structure of a convertible illuminated display case 1 according to the present invention.

The display case 1 includes the following elements:

- a box 2 having a front opening 3 with a rim 4 extending along at least a portion of its perimeter;
- a removable front panel 5 including a translucent wall (that can therefore be lit from behind), that in practice is decorated with an image, for example a photograph of products to which attention is to be drawn (but which can equally well be a portrait, a landscape, writing or any other type of image, printed or otherwise);
- at least one support 6 adapted to provide a base for displaying one or more object(s) 7 and intended to be placed in the box, preferably to the rear of the front opening;
- rear light sources 8 disposed at the back of the box;
- front light sources 9 disposed inside the box near the rim 4; and
- a power supply circuit 10 connected to the rear light sources 8 and to the front light sources 9.

The front and rear light sources 9, 8 are cold sources that do not give off significant heat, as will be discussed hereinafter.

The display case 1 has two configurations, depending on whether the front panel 5 is fitted or not; when the front panel 5 is fitted, the support 6 is preferably not fitted, so as to allow direct illumination of the translucent panel by the rear light sources 8 (the front light sources 9, which are not of any use in this situation, can be switched off or set to a minimum lighting configuration); on the other hand, if the front panel 5 is not fitted, the support 6 is illuminated by the front light sources 9 and, in some configurations, the rear light sources 8 can be switched off. The various energization modes of the front and rear light sources 9, 8 are defined by the power supply circuit 10, which can provide power supply modes that are predefined as a function of the configuration concerned (a choice between which can be made with a switch). In this example, the same unit can control the supply of power to a plurality of boxes (provided that they are in the same operating configuration, i.e. with or without the front panel).

In this embodiment the area of the front panel 5 is equal to that of the front face of the box 2 so that, when it is fitted, it conceals the rim 4. The rim 4 is visible in the configuration without the front panel 5, however, and must therefore be treated accordingly, e.g. by being polished and painted or lacquered, etc. In practice the rim 4 is narrow compared to the dimensions of the box 2, for example with a width of the same order as its thickness. In fact, the principal function of the rim 4 is to conceal the front light sources 9 at least in part; in that the front light sources 9 can be oriented with a non-zero inclination relative to the walls of the box 2, they can be mounted on an attached member that is itself inclined relative to the wall concerned; in this case (see FIGS. 2 to 5) the rim 4 can conceal the edge of this attached member. However, it must be understood that there is no minimum value for the dimension of this rim 4, which can therefore consist merely of the free edge of the box wall concerned.

In this example the box is a rectangular parallelepiped, but other shapes are feasible, for example squares and more generally polygons (such as hexagons, which are easy to stack). No condition applies to the shape if there is no intention to arrange a plurality of display cases contiguously.

The rear light sources 8 are advantageously in a central area of the back of the box 2, for example in the form of an array with a rectangular or even square mesh (preferably, although not necessarily, similar to the shape of the section of the box in a plane parallel to the front opening).

The front light sources 9 are advantageously distributed along a line running along the whole or a portion of the rim 4; in the example shown in FIG. 1, there are front light sources 9 not only along the lateral edges, but also along the top and bottom edges. In practice, the front light sources 9 are distributed over approximately the whole of the length of the side concerned. In a different embodiment, not shown, the front light sources 9 are disposed along only some sides, or even over only a median or other portion of some sides. The disposition of the front light sources 9 in a narrow strip can also be obtained by a quincunx arrangement of smaller light sources; however, the front light sources 9 can instead be grouped together in blocks in chosen areas of the front of the box 2.

As indicated above, there can be a plurality of energization modes of the front and rear light sources 9, 8. Thus there can be a mode in which only the rear light sources 8 are switched on; this mode can be chosen for the configuration in which the front panel 5 is fitted. Another mode can energize mainly the front light sources 9, especially for the configuration in which the support 6 is disposed in the box 2; under this mode, the front light sources 9 can be energized in the same manner or not, according to whether they are on the sides or at the top or bottom (groups of sources can then be energized differently, as required), and the rear light sources 8 can be switched off, or energized as in the first mode, or energized in an intermediate fashion. There can be shapes for the support 6 that, when lit from behind, contribute to drawing attention to the object 7 displayed on the support 6. This will become clear from the subsequent figures. There can therefore be a plurality of operating modes in the configuration without the front panel 5, according to the required lighting effect for the chosen support or the object displayed.

Figure 2:
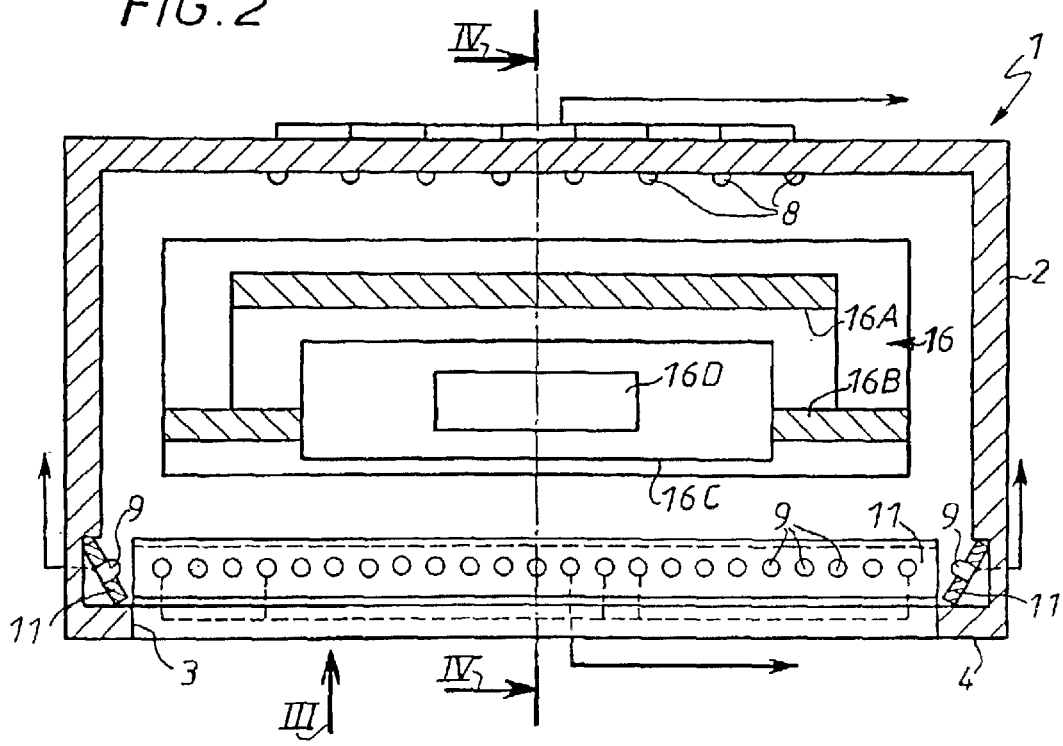
FIG. 2 is a more detailed view of the display case (with a different shape support) in section taken along the horizontal line II—II in FIG. 3.
Figure 3:
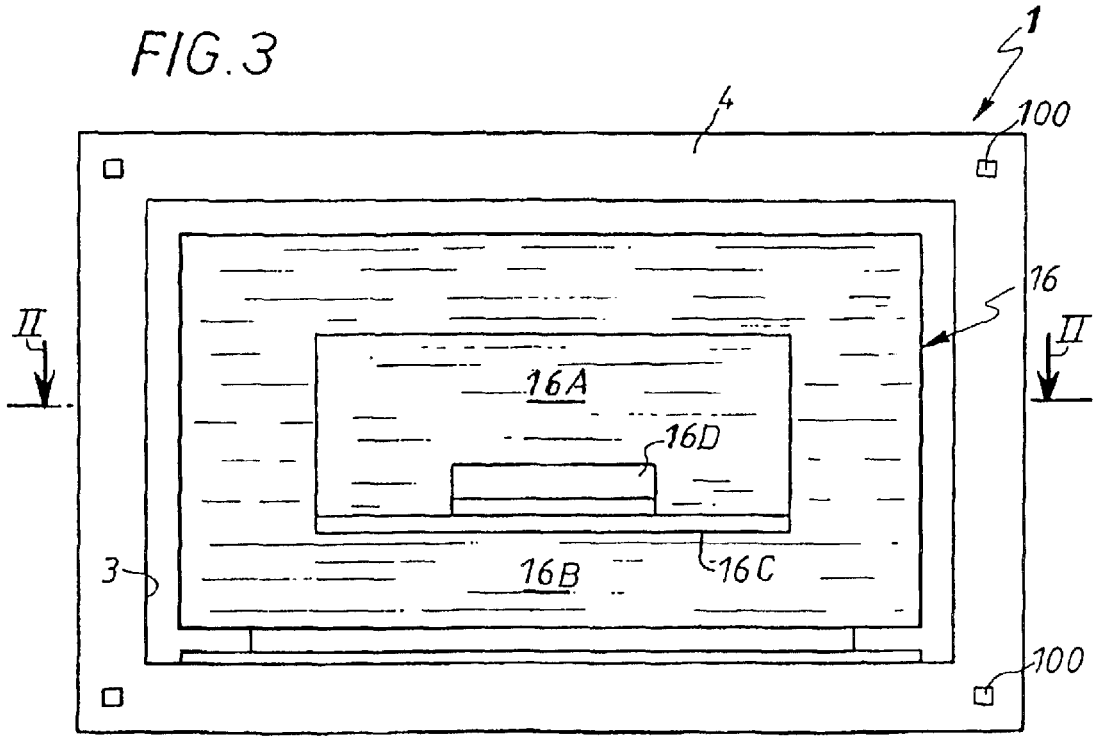
FIG. 3 is an elevation view of the display case as seen in the direction of the arrow I in FIG. 2.
Figure 4:
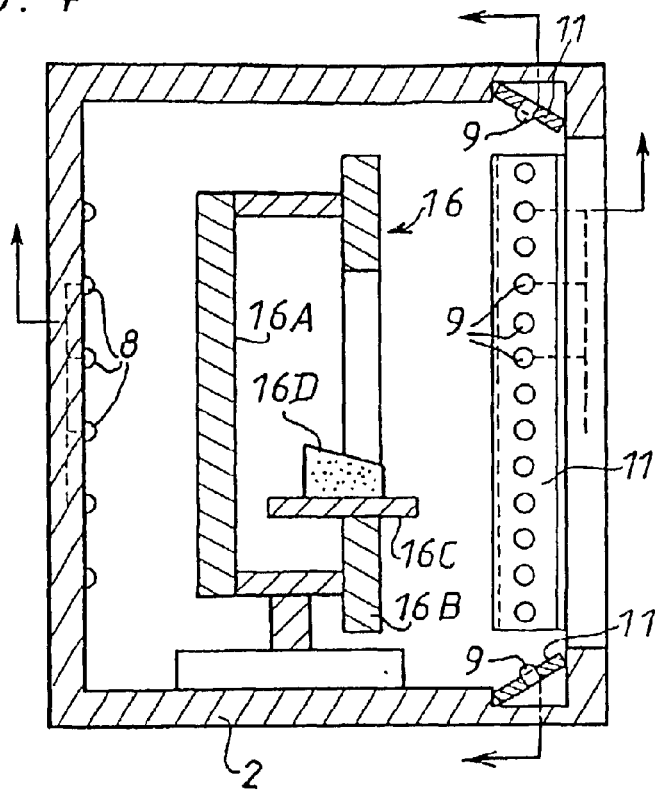
FIG. 4 is a view of the display case in section taken along the vertical line IV—IV in FIG. 2.

FIGS. 2 to 4 show the convertible illuminated display case 1 from FIG. 1 in more detail. Because these figures show the display case 1 in the configuration for displaying an object 7 on the support 6, the front panel 5 is not shown. Nevertheless, FIG. 3 symbolizes with small squares 100 any appropriate device for fixing the front panel 5 when that is required. The reference symbols in these figures are the same as those already used in FIG. 1, except in connection with the support, which is of a different type.

FIGS. 2 to 4 show that the area over which the rear light sources 8 are distributed can extend over more than two thirds of the width and the height. The front light sources 9 are disposed on strips 11 that are slightly inclined to the lateral wall concerned, for example at an angle from 10° to 30°, so that the front light sources 9 are themselves inclined relative to the walls of the box 2 and illuminate correctly what is on the support 6, even if the front light sources 9 are directional, i.e. have a narrow angle of illumination (for example of the order of ten degrees).

The front and rear light sources 9, 8 are preferably light-emitting diodes (LED), which have various advantages over incandescent, halogen and fluorescent light sources. Note that these diodes are used here for the purposes of illumination, although they are known best for uses in which their function is to be seen.

The light-emitting diodes can take the form of cylinders with a diameter of the order of 5 mm and a length of 9 mm, for example, terminated by a hemispherical dome. In the figures, the front and rear light sources 9, 8 are shown as projecting from their support, but they can alternately be flush with it.

Light-emitting diodes of this kind have a service life that can exceed 50,000 hours at a current of the order of 20 mA. The luminous intensity is proportional to the current flowing through the diode, and can therefore be graded without chromatic changes. These are cold sources in the sense that their temperature in practice does not exceed 25° C. As the (DC) voltage at their terminals is always below 5 volts (in practice 3.6 volts), they do not require any electrical insulation. They typically have a choice of aperture from 6° to 120° (the greater the aperture, the weaker the luminous intensity). They are preferably connected in parallel.

The front and rear light sources 9, 8 are preferably white, but in an alternate embodiment (not shown), both the front light sources 9 and the rear light sources 8 can be colored (in particular blue, green, yellow, amber, red, etc). The total number of light-emitting diodes for a square display case with a side length of 45 cm is 170, for example.

A support 16 shown inside the box 2 in FIGS. 2 to 4 has two walls, one in front of the other, and occupies the internal volume of the box 2. A back wall 16A of the support 16 has dimensions and is disposed in such a fashion that it conceals at least approximately the rear light sources 8; a front wall 16B of the support 16 incorporates an opening facing the back wall 16A, that defines a smaller niche inside the box 2, in particular formed by a base plate 16C carrying an individual support 16D, facilitating drawing attention to an object 7 that is small compared to the box 2; this principle can be retained with supports 16 having a smaller back wall 16A, but in this case the back wall 16A and the front wall 16B nevertheless advantageously have dimensions and are disposed relative to each other so that they conjointly conceal most of the rear light sources 8.

Figure 5:
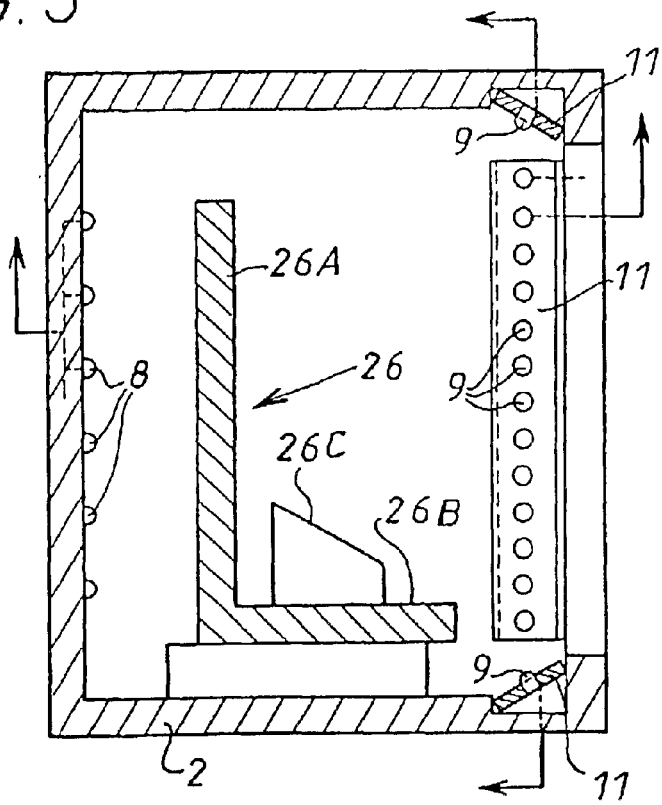
FIG. 5 is a view similar to FIG. 4, with the base shown diagrammatically in FIG. 1.

FIG. 5 shows the same component parts as those of the box 2 from FIGS. 2 to 4; the only difference lies in the use of a support 26 whose shape is closer to that of the support 6 from FIG. 1.

The support 26 essentially comprises a back wall 26A and a base plate 26B supporting an individual support 26C. The back wall 26A is advantageously sufficient in itself to conceal the rear light sources 8. However, smaller dimensions can be chosen, depending on the required effects.

Even if the back wall 16A or 26A masks the rear light sources 8, the rear light sources 8 can remain on, which can contribute to a lighting effect such as a halo. The rear light sources 8 have a more important illumination function if the back walls 16A and 26A, and even the front wall 16B, are made from translucent material.

Generally speaking, the walls 16A, 16B and 26A can be made from highly diverse, and either opaque or transparent, materials, as required, with all required intermediate gradations (or all feasible combinations of opaque, translucent and transparent areas).

In FIGS. 2 to 5, the arrows extending out from the front and rear light sources 9, 8 symbolize the connections to the power supply circuit 10.

Diverse variants can be proposed without departing from the scope of the invention, in particular with the facility of using simultaneously two or more identical or different supports (in the latter case, an asymmetric illumination mode may be required). Likewise, although white light sources are particularly beneficial, other colors can be used, possibly combined within the rear sources or the front sources. Furthermore, it is clear that, within each plurality of sources, as many groups of sources as may be required can be distinguished from each other.

Although it has been stated that light-emitting diodes have advantages that make them particularly suitable for the invention, it must be clearly understood that other cold light sources can be used in some applications.

What is claimed is:

1. A convertible illuminated display case comprising:

a box having a front portion and a rear portion, said front portion of said box having a front opening with a rim extending along at least a portion of the perimeter of said front opening;

a removable front panel having a translucent wall, said removable front panel being attachable to said front portion of said box such that said removable front panel substantially covers said front opening;

a support adapted to provide a base for displaying an object, said support being further adapted for placement within said box;

a plurality of rear cold light sources disposed at said rear portion of said box;

a plurality of front cold light sources disposed inside said box near said rim; and a power supply device connected to said plurality of rear cold light sources and to said plurality of front cold light sources.

2. A display case according to claim 1, wherein said plurality of front and rear cold light sources comprise light-emitting diodes.

3. A display case according to claim 1, wherein said power supply device has multiple operating modes corresponding to different modes of said plurality of front cold light sources and said plurality of rear cold light sources.

4. A display case according to claim 3, wherein said multiple operating modes of said power supply device comprise a first operating mode and a second operating mode, at least a portion of said plurality of rear cold light sources being less strongly energized in said first operating mode than in said second operating mode, at least a portion of said plurality of front cold light sources being more strongly energized in said first operating mode than in the second mode.

5. A display case according to claim 3, wherein said plurality of front cold light sources comprise a plurality of groups each having multiple energization modes.

6. A display case according to claim 1, wherein said plurality of rear cold light sources are disposed in a central area of said rear portion of said box.

7. A display case according to claim 1, wherein said plurality of rear cold light sources are disposed in an approximately periodic array.

8. A display case according to claim 7, wherein said box has a polygonal section comprising a plurality of walls, and said periodic array of said plurality of rear cold light sources comprises multiple rows of cold light sources parallel to at least one of said plurality of walls of said box.

9. A display case according to claim 1, wherein said plurality of front cold light sources comprise at least two groups of cold light sources disposed laterally on either side of said front opening.

10. A display case according to claim 1, wherein said plurality of front cold light sources comprise at least two groups of cold light sources, one of said at least two groups of cold light sources being disposed at a top portion of said box and another of said at least two groups of cold light sources being disposed at a bottom portion of said box.

11. A display case according to claim 1, wherein said plurality of front and rear cold light sources are the same color.

12. A display case according to claim 11, wherein said plurality of front and rear cold light sources are white.

13. A display case according to claim 1, wherein said support comprises a back wall adapted to conceal said plurality of rear cold light sources.

14. A display case according to claim 1, wherein said support comprises a back wall and a front wall having an opening, said opening of said front wall aligned facing said back wall, said back wall and said front wall being adapted to conjointly conceal said plurality of rear cold light sources.

15. A display case according to claim 1, wherein said box has a polygonal section.

16. A display case according to claim 15, wherein said box has a rectangular section.

17. A convertible illuminated display case comprising:

a box having a front portion and a rear portion opposite said front portion, said front portion of said box having a front opening with a rim extending along at least a portion of the perimeter of said front opening;

a removable front panel having a translucent wall, said removable front panel being attachable to said front portion of said box such that said removable front panel substantially covers said front opening;

at least one support adapted to provide a base for displaying at least one object, said at least one support being further adapted for placement within said box;

a first plurality of light-emitting diodes disposed at said rear portion of said box, and a second plurality of light-emitting diodes disposed near said rim, said first and second plurality of light-emitting diodes comprising multiple energization modes; and a power supply device connected to said first and second plurality of light-emitting diodes, said power supply device comprising multiple operating modes corresponding to said multiple energization modes of said first and second plurality light-emitting diodes.

* * * * *

UNITED STATES PATENT AND TRADEMARK OFFICE

CERTIFICATE OF CORRECTION

PATENT NO. : 6,869,154 B2
DATED : March 22, 2005
INVENTOR(S) : Francis Vandenbussche It is certified that error appears in the above-identified patent and that said Letters Patent is hereby corrected as shown below:

Column 3,
Line 40, kindly delete "I" and insert -- III --.

Signed and Sealed this

Sixth Day of September, 2005

JON W. DUDAS
*Director of the United States Patent and Trademark Office*